United States Patent [19]

Masaki et al.

[11] 4,091,780

[45] May 30, 1978

[54] CAR KNOCK PREVENTIVE SYSTEM

[75] Inventors: Kenji Masaki; Hidehiro Minami, both of Yokohama, Japan

[73] Assignee: Nissan Motor Company, Ltd., Japan

[21] Appl. No.: 654,743

[22] Filed: Feb. 3, 1976

[30] Foreign Application Priority Data

| | | |
|---|---|---|
| Feb. 7, 1975 | Japan | 50-15456 |
| Feb. 7, 1975 | Japan | 50-15458 |

[51] Int. Cl.[2] ..... F02M 7/12

[52] U.S. Cl. ..... 123/119 R; 123/119 D; 123/198 A; 261/41 D

[58] Field of Search ..... 261/41 D, DIG. 74; 123/DIG. 11; 261/69 R; 123/119 R, 119 D, 198 A

[56] References Cited

U.S. PATENT DOCUMENTS

| | | | |
|---|---|---|---|
| 2,568,987 | 9/1951 | Brunner | 261/41 D |
| 2,796,243 | 6/1957 | McCuffie | 261/41 D |
| 3,331,360 | 7/1967 | Fleming | 261/41 D |
| 3,517,653 | 6/1970 | Ariga et al. | 123/DIG. 11 |
| 3,620,511 | 10/1969 | Reinhardt et al. | 261/41 D |

*Primary Examiner*—Charles J. Myhre
*Assistant Examiner*—Ira S. Lazarus

[57] ABSTRACT

A valve closes a fuel passage or an air bleed of a low speed circuit of a carburetor to reduce the amount of air drawn from the low speed circuit into a high speed circuit by a main venturi vacuum higher than an induction passageway vaccum, for example, to zero to prevent an air-fuel mixture provided by the high speed circuit from being excessively leaned.

9 Claims, 8 Drawing Figures

FIG. 6
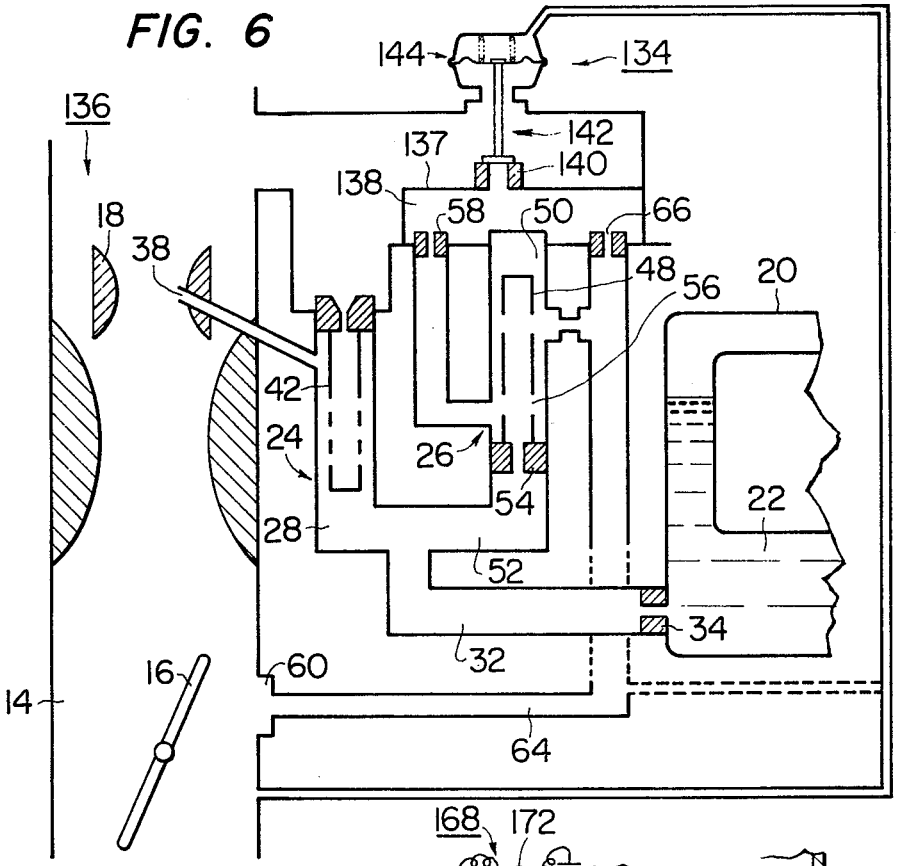
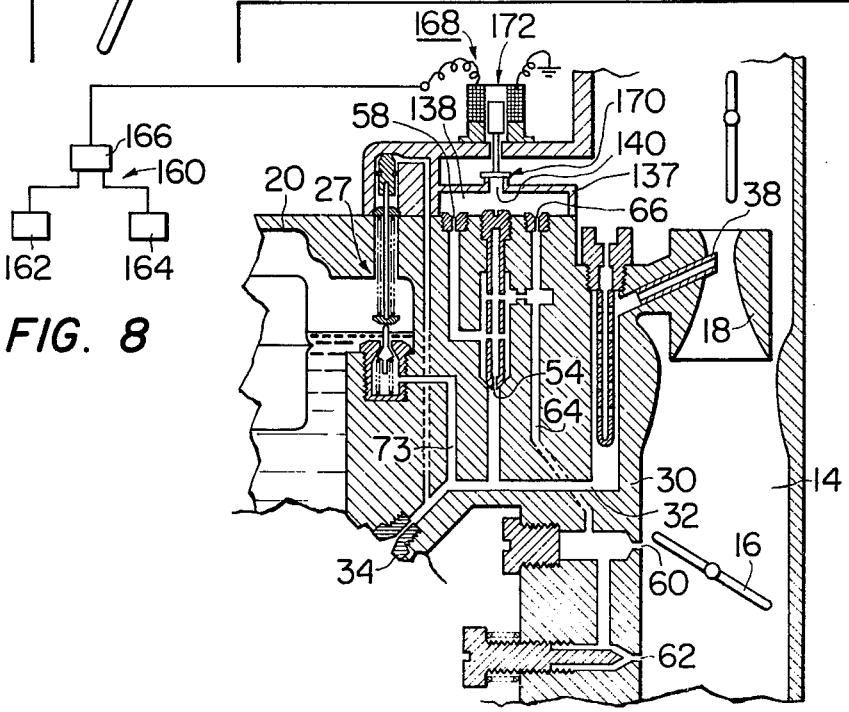
FIG. 8

CAR KNOCK PREVENTIVE SYSTEM

The present invention relates generally to a combination of a carburetor for an internal combustion engine of a motor vehicle and an engine or car knock preventive system and particularly to a combination of this type in which the engine knock, or as will be hereafter referred to, the car knock preventive system is constructed and arranged to prevent or reduce the flow of air drawn from a low speed circuit or idle system of the carburetor into a high speed circuit or main system thereof by a main venturi vacuum to prevent an air-fuel mixture provided by the high speed circuit from being undesirably or excessively made lean to the extent of causing the car knock during an engine operating condition at which the car knock occurs.

As is well known in the art, there is a tendency to set a carburetor of an internal combustion engine to provide a relatively lean air-fuel mixture having an air-fuel ratio which is equal to, near or higher than stoichiometric air-fuel ratio. This is to reduce the concentrations of air pollutants contained in exhaust gases discharged from the engine and to increase fuel economy. However, although the relatively lean air-fuel mixture, on the one hand, meets with these objects to a certain degree, it, on the other hand, deteriorates the driveability or operational performance of a motor vehicle driven by the engine to cause the so-called car knock phenomenon. The car knock takes place when the air-fuel ratio of an air-fuel mixture fed into the engine is within a surging occurring range, that is, when it is higher than about 16:1. Although an engine operating condition at which the car knock occurs is differed by a combination of an engine and a carburetor, the car knock occurs, for example, when the vacuum in the induction passageway at a position downstream of the throttle valve is below −250 mmHg at engine speeds within a wide range or when the engine speed is within a range between 2,000 and 3,000 r.p.m. and the last-mentioned induction passageway vacuum is within a range between −150 and −300 mmHg.

The car knock occurs by the reason that, when the opening of the throttle valve is increased and as a result the vacuum in the main venturi is increased above the vacuum in the low speed circuit at a slow running jet, air is drawn from the air bleeds of the low speed circuit into the high speed circuit by the increased main venturi vacuum to excessively or undesirably make an air-fuel mixture provided by the high speed circuit lean to the extent of having the air-fuel ratio higher than about 16:1.

As a solution to the problem of car knock, the cross sectional area of the main jet may be enlarged to increase the quantity of fuel fed from the fuel bowl to provide an enriched air-fuel mixture for the engine throughout its all operations. However, this solution is undesirable since the contents of air pollutants in the engine exhaust gases and fuel consumption are increased.

It is, therefore, an object of the invention to provide a combination of a carburetor and a car knock preventive system which prevents an air-fuel mixture provided by the high speed circuit of the carburetor from being undesirably or excessively made lean to the extent of causing the car knock, by reducing by a control valve operated pneumatically or electrically the amount of air, drawn from the low speed circuit into the high speed circuit by a main venturi vacuum, for example, to zero when the engine is in an operating condition at which the car knock occurs.

This and other objects and advantages of the invention will become more apparent from the following detailed description taken in conjunction with the accompanying drawings in which:

FIG. 6 is a schematic cross sectional view of a third preferred embodiment of a combination of a carburetor and a car knock preventive system according to the invention;

FIG. 8 is a schematic cross sectional view of a fifth preferred embodiment of a combination of a carburetor and a car knock preventive system according to the invention.

Figure 1:
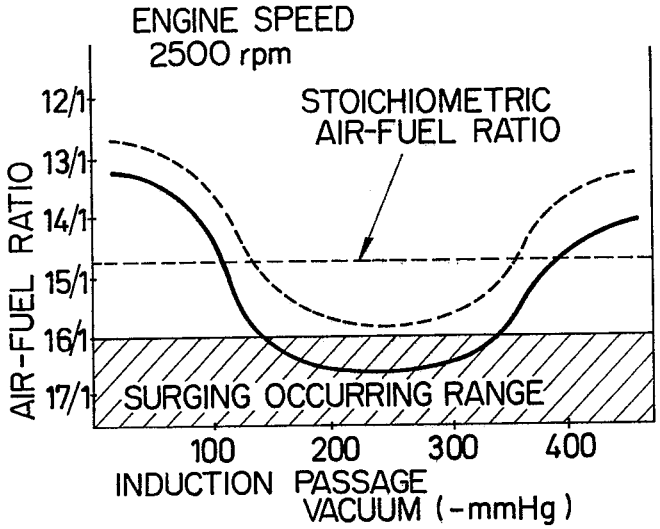
FIG. 1 is a graphic representation of the relationship between the air-fuel ratio of an air-fuel mixture causing the so-called car knock and the vacuum in an induction passageway at a position downstream of a throttle valve.

Referring to FIG. 1 of the drawings, there is shown the relationship between the air-fuel ratio of an air-fuel mixture provided by carburetor which is set to provide an air-fuel mixture having a stoichiometric air-fuel ratio (14.8:1) as shown by the solid line and is not provided with a car knock preventive system and the vacuum in an induction passage at a position downstream of a throttle valve of the carburetor. When the engine having the carburetor is idling or running at a low speed and low load condition, the air-fuel mixture is enriched by a slow running mixture supply circuit of the carburetor as shown by the right part of the solid curved line in the graph of FIG. 1. When the engine is running at a high speed and high load condition, the air-fuel mixture is enriched by a main mixture supply circuit and a power system as shown by the left part of the solid curved line. When the engine is running at a medium speed and medium load condition, the air-fuel mixture is made lean and when its air-fuel ratio is increased to a value higher than about 16:1 (within the surging occurring range) as shown by the mid portion of the solid curved line, the car knock occurs. The dotted curved line in the graph shows the air-fuel ratio of the air-fuel mixture provided as the solution as per the introduction of the specification.

Figure 2:
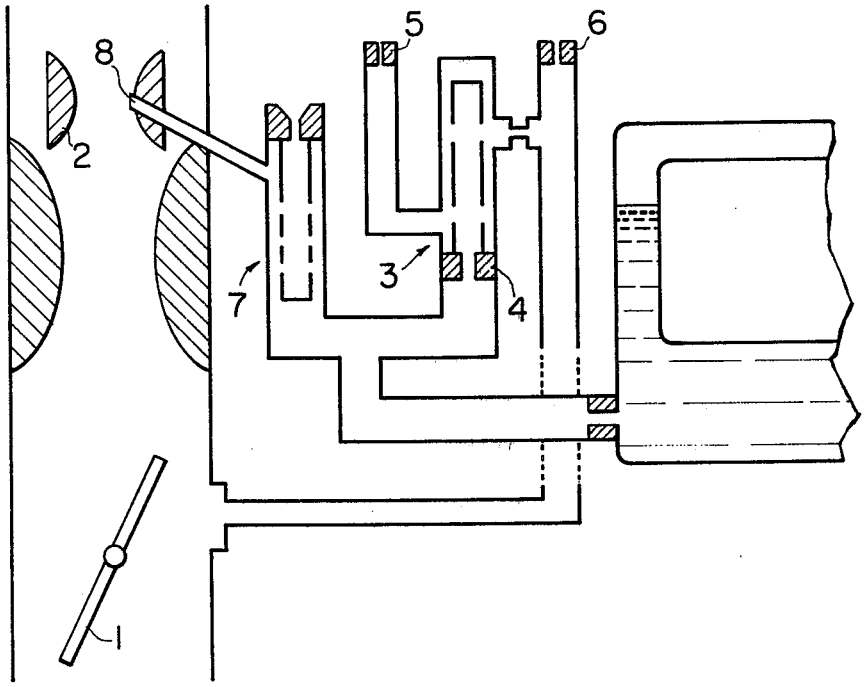
FIG. 2 is a schematic cross sectional view of a conventional carburetor providing an air-fuel mixture which causes the so-called car knock.

Referring to FIG. 2 of the drawings, there is shown a conventional carburetor which is not provided with a car knock preventive system. When the opening of a throttle valve 1 is increased and the vacuum in a main venturi 2 is increased above the vacuum in an idle system or slow running mixture supply circuit 3 at an idling or slow running jet 4, air is drawn from first and second air bleeds 5 and 6 of the slow running mixture supply circuit 3 into a main system or main mixture supply circuit 7 by the main venturi vacuum to make an air-fuel mixture fed from a main nozzle 8 into the main venturi 2 lean and thus cause the car knock.

Figure 3:
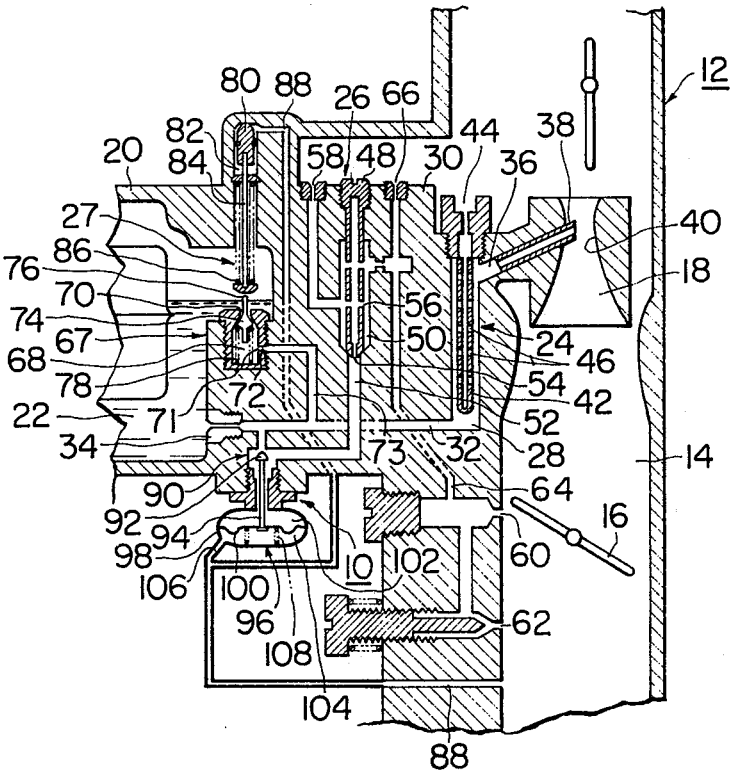
FIG. 3 is a schematic cross sectional view of a first preferred embodiment of a combination of a carburetor and a car knock preventive system according to the invention.

Referring to FIG. 3 of the drawings, there is shown a car knock preventive system according to the invention, generally designated by the reference numeral 10, and a carburetor 12 of an internal combustion engine (not shown) which is combined with the car knock preventive system 10.

The carburetor 12 comprises a portion of an induction passageway 14 vented to the ambient atmosphere through an air cleaner (not shown) and communicating with an intake port of a combustion chamber of the engine. A throttle valve 16 is rotatably mounted in the induction passageway 14. A main venturi 18 is arranged in the induction conduit 14 at a position upstream of the throttle valve 16 and coaxially with the induction conduit 14.

The carburetor 12 also comprises a fuel bowl 20 containing liquid fuel 22 automatically maintained at a constant level in a conventional manner, main and idle systems or main and slow running mixture supply circuits 24 and 26, and a power system or additional fuel supply system 27. The main system 24 includes a fuel well 28 vertically formed in the carburetor body 30 and communicating at its lower portion with a main fuel passage 32, which communicates with the fuel bowl 20 through a main jet 34. The fuel well 28 communicates at its upper portion with the main venturi 18 through a passage 36. A main nozzle 38 is tightly fitted in the passage 36 and projects into the throat region 40 of the main venturi 18. A hollow member or tube 42 is secured and extends in the fuel well 28 and communicates with the induction passageway 14 through a main air bleed 44 to admit air into the interior of the hollow member 42. The hollow member 42 serves as a main air-fuel mixer and is formed with a plurality of ports 46 spaced along its length to permit air from its interior into the fuel well 28 for emulsifying the fuel to provide a combustible air-fuel mixture for the engine during its operation under load.

The idle system 26 includes a hollow member or tube 48 fixedly received and extending in a bore 50 vertically formed in the carburetor body 30. A passage 52 communicates with the main fuel passage 32 and through a slow running jet 54 with a lower portion of the hollow member 48 so that fuel is fed into the interior thereof from the passage 52. The hollow member 48 and the passage 52 form a slow running fuel passage. The hollow member 48 serves as a slow running air-fuel mixer and is formed with a plurality of ports 56 spaced along its length to provide fluid communication between its interior and a first slow running air bleed 58, which communicates with the induction passageway 14. Air is admitted into the interior of the hollow member 48 through the slow running air bleed 58 and the ports 56 to mix with the fuel. The hollow member 48 communicates with slow running and idling ports 60 and 62 through a slow running mixture passage 64. The slow running port 60 opens into the induction passageway 14 at a position immediately upstream of the upper edge of the throttle valve 16 in its fully closed position, while the idling port 62 opens into the induction passageway 14 at a position downstream of the slow running port 60. The slow running mixture passage 64 communicates with the induction passageway 14 through a second slow running air bleed 66 to receive air for mixing with a mixture of air and fuel from the hollow member 48 to provide a combustible air-fuel mixture for the engine at idle and low or extremely low speeds.

The power system 27 functions to feed additional fuel into the main fuel passage 32 when an increased power is required of the engine as during, for example, acceleration, and slope ascending and high speed and high load running operations. The power system 27 comprises a flow control valve 67 which includes a valve chamber 68 having an inlet port 70 opening into the liquid fuel in the fuel bowl 20 and an outlet port 71 communicating with the main fuel passage 32 through a power jet 72 and a power fuel passage 73. A valve head 74 is movably located in the valve chamber 68 to close and open the inlet port 70. A valve stem 76 extends from the valve head 74 into the fuel bowl 20 through the inlet port 70. A compression spring 78 is located in the valve chamber 68 and urges the valve head 74 into a position to close the inlet port 70. A piston 80 is slidably fitted in a chamber 82 formed in the carburetor body 30 and has an actuating rod 84 extending from one side of the piston 80 toward the valve stem 76. A compression spring 86 is provided to urge the actuating rod 84 and the piston 80 toward the valve stem 76. The chamber 82 communicates at its portion on the other side of the piston 80 with the induction passageway 14 at a position downstream of the throttle valve 16 or an intake manifold (not shown) of the engine through a conduit or passage 88. When the vacuum in the induction passageway 14 at the last mentioned position or in the intake manifold is above a predetermined level, the piston 80 is in a position in which the actuating rod 84 causes the valve head 74 to close the inlet port 70. When the above-mentioned induction passageway vacuum is below the predetermined level, the piston 80 is in a position in which the actuating rod 84 causes the valve head 74 to open the inlet port 70 to feed additional fuel into the main fuel passage 32 to increase the power of the engine.

The car knock preventive system 10 comprises a flow control valve 90 which, when the vacuum in the throat region 40 of the main venturi 18 is above the vacuum in the slow running fuel passage at the position of the slow running jet 54 and/or in the induction passageway 14 at the positions of the slow running and idling ports 62 and 60 in excess of a predetermined value, prevents air from being drawn from the first and second slow running air bleeds 58 and 66 and/or the ports 60 and 62 into the main fuel passage 32 through the slow running fuel passage 52 by the main venturi vacuum to thereby prevent an air-fuel mixture provided by the main system 24 from being undesirably made lean to cause the car knock. The flow control valve 90 comprises a valve head 92 operably located in the slow running fuel passage 52 to close and open it, and a valve steam 94 extending from the valve head 92 to the exterior of the carburetor body 30. An actuator 96 is provided to operate the flow control valve 90 in accordance with the vacuum in the induction passageway 14 at a position downstream of the throttle valve 16 and comprises a housing 98, and a pressure sensitive deformable member such as a flexible diaphragm 100 dividing the interior of the housing 98 into first and second chambers 102 and 104. The first chamber 102 communicates with the ambient atmosphere, while the second chamber 104 communicates with the conduit 88 through a conduit 106. The valve stem 94 passes through the first chamber 102 and is centrally fixedly connected to the diaphragm 100. A compression spring 108 is located in the second chamber 104 to urge the diaphragm 100 and the valve stem 94 into a position in which the valve head 92 closes the slow running fuel passage 52.

Figure 4:
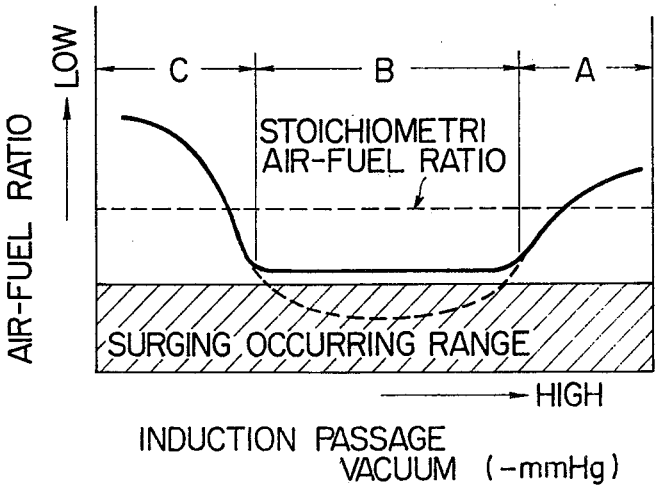
FIG. 4 is a graphic representation of the relationship between the air-fuel ratio of an air-fuel mixture provided by the carburetor of FIG. 3 and the vacuum in an induction passageway at a position downstream of a throttle valve of the carburetor.

The combination of the carburetor 12 and the car knock preventive system 10 thus far described is operated as follows:

When the engine is running at a low speed and at a low load condition, the vacuum in the slow running fuel passage at the position of the slow running jet 54 or in the induction passageway 14 at the positions of the slow running and idling ports 60 and 62 or at a position downstream of the throttle valve 16 is above the vacuum in the main venturi 18 since the throttle valve 16 is opened a relatively small amount. As a result, the flow control valve 90 is urged into a position in which the valve head 92 opens the slow running fuel passage 52 by the diaphragm 100 operated by the difference between the atmospheric pressure in the first chamber 102 and the induction passageway vacuum in the second chamber 104 overcoming the force of the spring 108. In this instance, the induction passageway 14 is formed therein with a relatively rich air-fuel mixture by a mixture of air and fuel drawn from the slow running and idling ports 60 and 62 into the induction passageway 14. The relationship between the air-fuel ratio of the rich air-fuel mixture and the last-mentioned induction passageway vacuum is shown by the solid curved line present within the range A in the graph of FIG. 4.

When the speed and/or load of the engine is increased by increasing the opening of the throttle valve 16, the vacuum in the slow running fuel passage at the position of the slow running jet 54 and/or in the induction passageway 14 at the position downstream of the throttle valve 16 is reduced to a value below the main venturi vacuum and at which, unless the car knock preventive system 10 is provided, air is drawn from the idle system 26 into the main system 24 by the main venturi vacuum to undesirably make an air-fuel mixture provided by the main system 24 lean to cause the car knock. Under this condition, the flow control valve 90 is urged into a position in which the valve head 92 closes the fuel passage 52 by the diaphragm 100 operated by the force of the spring 108 overcoming the difference between the atmospheric pressure in the chamber 102 and the induction passageway vacuum in the chamber 104 to prevent the admission of air from the air bleeds 58 and 66 and/or the ports 60 and 62 into the main air-fuel mixer 42 through the fuel passages 52 and 32. Thus, an air-fuel mixture fed from the main system 24 into the main venturi 18 is formed by fuel from the main fuel passage 32 and only a set amount of air from the main air bleed 44 to prevent the air-fuel mixture from being undesirably made lean to cause the car knock. In this instance, the air-fuel mixture provided by the main system 24 has an air-fuel ratio shown by the solid curved line with the range B in the graph of FIG. 4 and reduced below an air-fuel ratio which is shown by the dotted curved line within the range B which causes the car knock.

When a high load condition of the engine occurs by further increasing the opening of the throttle valve 16, the main venturi vacuum remains above the vacuum in the slow running fuel passage and in the induction passageway 14 at the last-mentioned positions. Accordingly, the flow control valve 90 closes the slow running fuel passage 52 to prevent the admission of air from the slow running mixture supply circuit 26 into the main air-fuel mixer 42 and accordingly prevent the occurrence of the car knock. In this instance, the flow control valve 67 of the power system 27 is forced into a position to open the inlet port 70 by the piston 80 and the actuating rod 84 operated by a reduced vacuum in the induction passageway 14 conducted by the conduit 88 so that additional fuel is fed into the main fuel passage 32 from the chamber 68. In this instance, the amount of the additional fuel is adjusted to provide an air-fuel mixture having a set air-fuel ratio shown by the solid curved line present within the range C in the graph of FIG. 4, for example, by suitably selecting the cross sectional area of the power jet 72.

Figure 5:
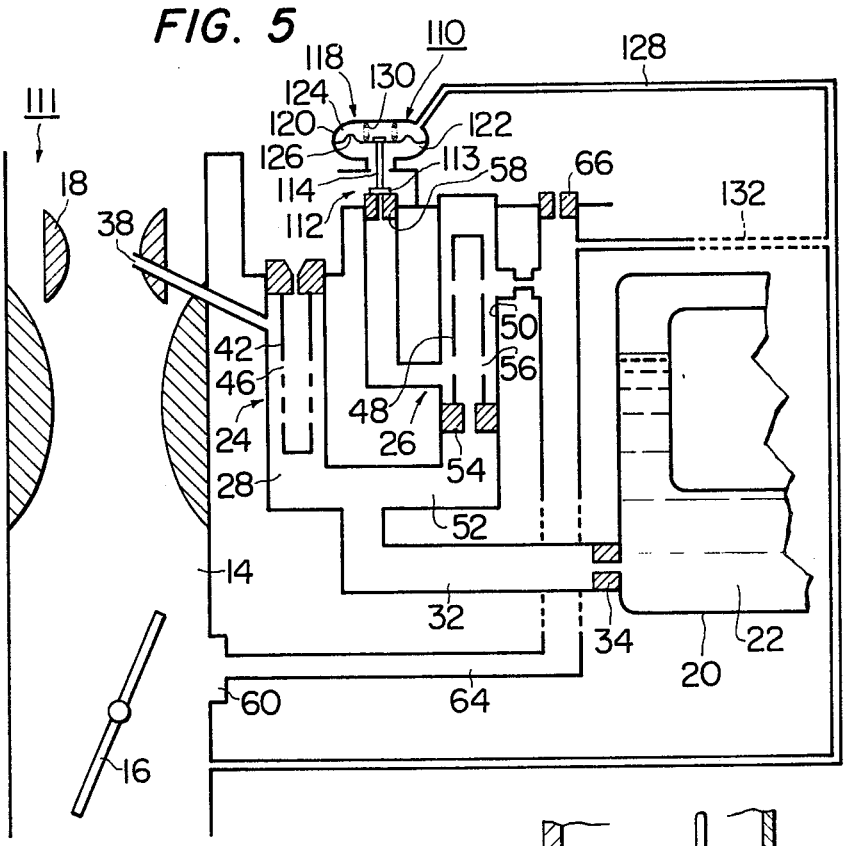
FIG. 5 is a schematic cross sectional view of a second preferred embodiment of a combination of a carburetor and a car knock preventive system according to the invention.

A car knock preventive system according to the invention is combined with a carburetor including a main mixture supply circuit set to provide an air-fuel mixture having such an air-fuel ratio that prevents the air-fuel mixture from being excessively made lean to cause the car knock by closing one or more or all of a plurality of air bleeds of a slow running mixture supply curcuit of the carburetor to reduce the flow of air drawn from the idle system into the main system by a main venturi vacuum when the engine is in an operating condition at which the car knock occurs. Two embodiments of such a combination of a carburetor and a car knock preventive system are shown in FIGS. 5 and 6 of the drawings. In FIGS. 5 and 6, similar component elements and similarly functioning component elements are designated by the same reference numerals as those used in FIG. 3.

Referring to FIG. 5, in this embodiment, a car knock preventive system, generally designated by the reference numeral 110, is combined with a carburetor 111 including a high speed circuit 24 set to provide a relatively rich air-fuel mixture having such an air-fuel ratio that is prevented from being made lean to cause the car knock by closing only a first air bleed 58 of a low speed circuit 26 of the carburetor 111 under the engine operating condition at which the car knock occurs. The car knock preventive system 110 comprises a flow control valve 112 comprising a valve head 113 seated on and unseated from the first air bleed 58 to close and open it, a valve stem 114 extending from the valve head 113, and an actuator 118 for operating the flow control valve 112. The actuator 118 is constructed similarly to the actuator 96 shown in FIG. 3 and comprises a housing 120 having first and second chambers 122 and 124, and a flexible diaphragm 126 which structurally correspond to the housing 98, the first and second chambers 102 and 104, and the diaphragm 100 of the actuator 96 of FIG. 3. The second chamber 124 communicates through a conduit 128 with an induction passageway 14 at a position downstream of a throttle valve 16 of the carburetor 111. The valve stem 114 is centrally fixedly connected to the diaphragm 126. A compression spring 130 is located in the second chamber 124 and urges the diaphragm 126 into a position in which the valve head 113 closes the first air bleed 58. Alternatively, the second chamber 124 may communicate with the low speed circuit 26 at a position downstream of a second air bleed 66 through the conduit 128 and a conduit 132 by suitably selecting the force of the spring 130.

The car knock preventive system 110 thus far described is operated as follows:

When the vacuum in the slow running fuel passage at the position of the slow running jet 54 and/or in the induction passageway 14 at the position downstream of the throttle valve 16 is above a predetermined value, for example, −250 mmHg, or above the vacuum in a main venturi 18 of the carburetor 111, the flow control valve 112 is urged into a position to open the first air bleed 58 by the actuator 118 similarly to the embodiment shown in FIG. 3.

When the last-mentioned slow running fuel passage and/or induction passageway vacuum is below the predetermined value or below the main venturi vacuum, the flow control valve 112 is urged into a position to close the first air bleed 58 by the actuator 118 similarly to the embodiment of FIG. 3. Accordingly, the flow of air drawn from the low speed circuit 26 into a main air fuel mixer 42 of a high speed circuit 24 by the main venturi vacuum is reduced to prevent excessive dilution of the air-fuel mixture formed in the main air-fuel mixer 42. Thus, the air-fuel mixture drawn into the engine is not excessively diluted thereby preventing the occurrence of the car knock.

Referring to FIG. 6, in this embodiment, a car knock preventive system, generally designated by the reference numeral 134, is combined with a carburetor 136 including a high speed or main circuit 24 set to provide a relatively lean air-fuel mixture having such an air-fuel ratio that is prevented from being made lean to cause the car knock by closing both first and second air bleeds 58 and 66 of a low speed circuit 26 of the carburetor 136 under an engine operating condition at which the car knock occurs. In this instance, the carburetor 136 is provided with a housing 137 defining therein an air chamber 138 into which the first and second air bleeds 58 and 66 open and having a common air inlet port 140 communicating with an induction passageway 14 of the carburetor 136. A flow control valve 142 and an actuator 144 such as the flow control valve 90 and the actuator 96 of FIG. 3 are provided to normally open the common air inlet port 140 and to close it when the vacuum in the induction passageway 14 at a position downstream of a throttle valve 16 of the carburetor 136 is below the vacuum in a main venturi 18 thereof to thereby reduce the flow of air drawn from a low speed circuit 26 into the high speed circuit 24 to prevent the occurrence of the car knock, similarly to the embodiments of FIGS. 3 and 5.

Although the car knock preventive system 134 has been described as comprising one flow control valve for collectively closing a plurality of air bleeds of a low speed circuit of a carburetor, a car knock preventive system according to the invention can comprise a plurality of flow control valves for individually closing a plurality of air bleeds of a low speed circuit of a carburetor, respectively.

Figure 7:
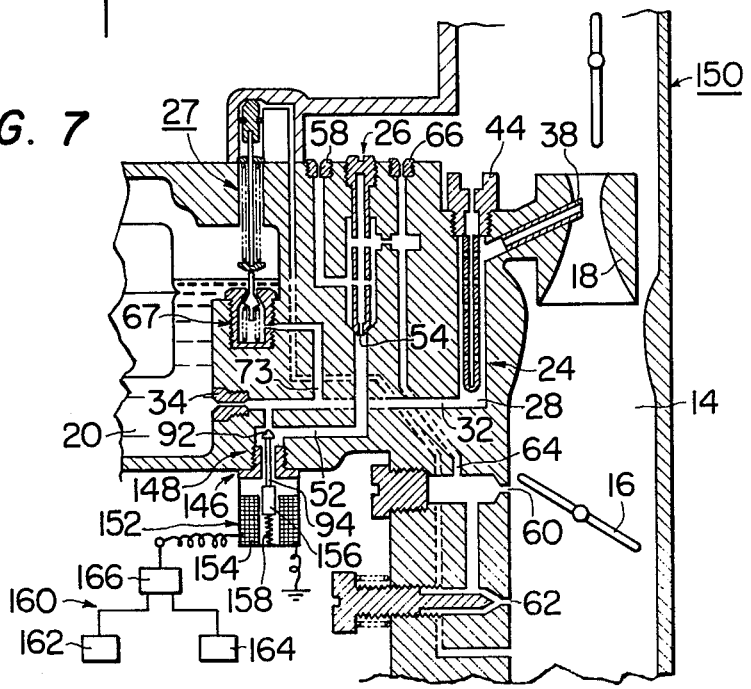
FIG. 7 is a schematic cross sectional view of a fourth preferred embodiment of a combination of a carburetor and a car knock preventive system according to the invention.

Referring to FIGS. 7 and 8 of the drawings, there are shown fourth and fifth preferred embodiments of a combination of a carburetor and a car knock preventive system according to the invention. These embodiments are different from the embodiments thus far described in that an actuator of a flow control valve is of an electrically controlled type. Thus, in FIGS. 7 and 8, similar component elements and similarly functioning component elements are designated by the same reference numerals as those used in FIGS. 3 and 6.

In the embodiment shown in FIG. 7, the car knock preventive system, generally designated by the reference numeral 146, comprises a flow control valve 148 which closes and opens a fuel passage 52 of a low speed circuit 26 of a carburetor 150 similarly to the flow control valve 90 of FIG. 3 and is different from the car knock preventive system 10 of FIG. 3 in that the flow control valve 148 is operated by a solenoid controlled actuator 152. The actuator 152 comprises a solenoid 154, a core 156 axially movably located in the solenoid 154 and to which a valve stem 94 of the flow control valve 148 is fixedly connected, and a tension spring 158 urging the core 156 into a position in which a valve head 92 of the flow control valve 148 opens the fuel passage 52. The solenoid 154 is electrically connected to control means 160 which senses an operating condition or conditions of the engine, at which the car knock occurs and/or the power system 27 is not operated to feed no additional fuel into the main fuel passage 32, to generate an electric output signal applied to the solenoid 154. The control means 160 comprises, for example, an engine speed sensor 162, a vacuum sensor 164 for sensing the vacuum in an induction passageway 14 at a position downstream of a throttle valve 16 or the vacuum in an intake manifold (not shown) of the engine, and gate means such as an AND gate logic circuit 166 connected to the solenoid 154 and to which the sensors 162 and 164 are connected in parallel. The sensor 162 generates an electric output signal in response to an engine speed within a range between, for example, 2,000 and 3,000 rpm. The sensor 164 generates an electric output signal in response to an induction passageway vacuum or an engine intake manifold vacuum within a range between, for example, −150 and −300 mmHg. The gate means 166 generates an electric output signal only when the output signals of the sensors 162 and 164 are concurrently generated. A vacuum sensor sensing the vacuum in a main venturi 18 may be employed in place of the sensors 162 and 164 and the gate means 166.

The combination of the carburetor 15 and the car knock preventive system 146 thus far described is operated as follows:

When the engine is in a low load condition, since the throttle valve 16 is opened a small amount the vacuum in the slow running fuel passage at the position of the slow running jet 54 and/or in the induction passageway 14 at the position downstream of the throttle valve 16 is at a high value such as, for example, −450 mmHg at which the car knock does not occur. Accordingly, the sensors 162 and 164 and the gate means 166 generate no output signals to cause the flow control valve 148 to open the fuel passage 52. In this instance, the induction passageway 14 is filled therein with a relatively rich air-fuel mixture for the engine by fuel drawn from slow running and idling ports 60 and 62 of the low speed circuit 26 thereinto. The relationship between the air-fuel ratio of the air-fuel mixture and the induction passageway vacuum is shown by the solid curved line present within the range A in the graph of FIG. 4.

When the opening of the throttle valve 16 is gradually increased and as a result, the enging speed is increased to the range between 2,000 and 3,000 rpm and the induction passageway vacuum is reduced to the range between −150 and −300 mmHg, each of the sensors 162 and 164 generates an output signal applied to the gate means 166, which generates an output signal. The solenoid 154 is energized by the signal from the gate means 166 to cause the flow control valve 148 to close the fuel passage 52 so that air is prevented from being drawn from the low speed circuit 26 into the high speed circuit 24 by the main venturi vacuum to prevent an air-fuel mixture provided by the high speed circuit from being undesirably made lean to the extent of causing the car knock.

When the opening of the throttle valve 16 is further increased to attain a high load condition and as a result, the engine speed and the induction passageway vacuum is increased and reduced beyond the above-mentioned ranges, each of the sensors 162 and 164 ceases to generate the output signal. Accordingly, the solenoid 154 is de-energized so that the flow control valve 148 is caused to open the fuel passage 52 to permit air to be drawn from the low speed circuit 26 into the high speed circuit 24 by the main venturi vacuum. However, at this time, the piston 80 of the power system 27 is operated by the reduced induction passageway vacuum to cause the flow control valve 67 to open the inlet port 70 of the chamber 68 to feed additional fuel into the main fuel passage 32 through the power fuel passage 73. The additional fuel not only prevents an air-fuel mixture provided by the high speed circuit 24 from being made lean by the air from the low speed circuit 26 to prevent the occurrence of the car knock but provides an enriched air-fuel mixture to increase the power of the engine. In this instance, the relationship between the air-fuel ratio of the enriched air-fuel mixture and the induction passageway vacuum is shown by the solid curved line present within the range C in the graph of FIG. 4.

The control means 160 can be modified in such a manner that the solenoid 154 causes the flow control valve 148 to close the fuel passage 52 when the engine is in a high load condition at which the power system 27 feeds additional fuel into the main fuel passage 32. In this instance, for example, the diameter or cross sectional area of the power jet 72 is reduced so as to not provide an excessively enriched air-fuel mixture.

The embodiment shown in FIG. 8 is different from the embodiment shown in FIG. 6 in that the car knock preventive system, generally designated by the reference numeral 168, comprises a flow control valve 170 and an actuator 172 such as the flow control valve 148 and the actuator 152 of FIG. 7 in place of the flow control valve 142 and the actuator 144. The actuator 172 causes the flow control valve 170 to normally open a common air inlet port 140 of an air chamber 138 and to, in response to an output signal from control means 160 representing that the engine is in an operating condition at which the car knock occurs, close the air inlet port 140 so that the amount of air drawn from a low speed circuit 26 into a high speed circuit 24 is reduced to prevent an air-fuel mixture provided by the high speed circuit 24 from being excessively made lean to the extent of causing the car knock.

It will be appreciated that the invention provides a combination of a carburetor and a car knock preventive system in which a flow control valve closes a fuel passage or an air bleed of a low speed circuit of the carburetor to reduce the amount of air drawn from the low speed circuit into a high speed circuit by a main venturi vacuum above an induction passageway vacuum to prevent an air-fuel mixture provided by the high speed circuit from being excessively made lean to the extent of causing the car knock so that a lean air-fuel mixture be fed into an engine not only to reduce the contents of air pollutants contained in the engine exhaust gases and fuel consumption but to prevent the driveability of a motor vehicle driven by the engine from being deteriorated by the occurrence of the car knock.

What is claimed is:

1. A car knock preventive system in combination with a carburetor for an internal combustion engine of a motor car, said carburetor including an induction passageway through which air for combustion of fuel in a combustion chamber of an internal combustion engine passes, a throttle valve rotatably mounted in the induction passageway, a main venturi located in the induction passageway upstream of the throttle valve, a fuel bowl containing liquid fuel therein, a main fuel passage communicating with the fuel bowl and opening into the main venturi for providing a main air-fuel mixture for the engine, an idle and low speed running fuel passage diverging from the main fuel passage and opening into the induction passageway downstream of the throttle valve in its open position for providing an idle and low speed running air-fuel mixture for the engine, and first and second air bleeds each of which communicates with the idle and low speed running fuel passage and with the atmosphere, said car knock preventive system comprising a flow control valve for obstructing communication of the diverging point of the idle and low speed running fuel passage from the main fuel passage with the atmosphere by way of at least one of the first and second air bleeds for reducing the amount of air drawn from said at least one air bleed into the main venturi by the vacuum therein in response to an operating condition of the engine at which condition a car knock is apt to occur and for normally providing said communication.

2. A car knock preventive system as claimed in claim 1, in which said flow control valve is disposed in the idle and low speed running fuel passage between said diverging point and the first and second air bleeds.

3. A car knock preventive system as claimed in claim 2, in which said flow control valve includes an actuator comprising a flexible diaphragm having at a side thereof a fluid chamber, and passage means for admitting an engine suction vacuum into said fluid chamber, said diaphragm being operatively connected to said flow control valve for causing same to open the idle and low speed running fuel passage in response to an engine suction vacuum above a predetermined value below which the car knock is apt to occur and to close the idle and low speed running fuel passage in response to an engine suction vacuum below said predetermined value.

4. A car knock preventive system as claimed in claim 2, in which said flow control valve includes an actuator comprising solenoid means, a first sensor for sensing an engine suction vacuum within a predetermined range, within which a car knock is apt to occur, to generate a first output signal, a second sensor for sensing a speed of the engine within a predetermined range, within which the car knock is apt to occur, to generate a second output signal, gate means electrically connected to said first and second sensors for generating a third output signal which concurrently receives said first and second output signals, said solenoid means being electrically connected to said gate means for causing said flow control valve to open the idle and low speed running fuel passage when said gate means fails to generate said third output signal and to close the idle and low speed running fuel passage when said gate means generates said third output signal.

5. A car knock preventive system as claimed in claim 1, in which said flow control valve is located for opening and closing one of the first and second air bleeds.

6. A car knock preventive system as claimed in claim 5, in which said flow control valve includes an actuator comprising a flexible diaphragm having at a side thereof a fluid chamber, and passage means for admitting an engine suction vacuum into said fluid chamber, said diaphragm being operatively connected to said flow control valve for causing same to open and close said one air bleed in response to the engine suction vacuums which are above and below a predetermined value, respectively, below which a car knock is apt to occur.

7. A car knock preventive system as claimed in claim 1, further comprising a housing defining therein an air chamber into which the first and second air bleeds open, said housing having a common air inlet port providing communication between said air chamber and the atmosphere, in which said flow control valve is located to open and close said common air inlet port.

8. A car knock preventive system as claimed in claim 7, in which said flow control valve includes an actuator comprising a flexible diaphragm having at a side thereof a fluid chamber, and passage means for admitting an engine suction vacuum into said fluid chamber, said diaphragm being operatively connected to said flow control valve for causing same to open said air inlet port in response to an engine suction vacuum above a predetermined value below which the car knock is apt to occur and close said air inlet port in response to an engine suction vacuum below said predetermined value.

9. A car knock preventive system as claimed in claim 7, in which said flow control valve includes an actuator comprising solenoid means, a first sensor for sensing an engine suction vacuum within a predetermined range, within which a car knock is apt to occur, to generate a first output signal, a second sensor for sensing a speed of the engine within a predetermined range, within which the car knock is apt to occur, to generate a second output signal, gate means electrically connected to said first and second sensors for generating a third output signal which concurrently receives said first and second output signals, said solenoid means being electrically connected to said gate means for causing said flow control valve to open said air inlet port when said gate means fails to generate said third output signal and to close said air inlet port when said gate means generates said third output signal.

* * * * *